US008358203B1

(12) United States Patent
Perry

(10) Patent No.: US 8,358,203 B1
(45) Date of Patent: Jan. 22, 2013

(54) CHILDREN'S TOOTHBRUSH REMINDER SET

(76) Inventor: Shannon M. Perry, Southfield, MI (US)

( * ) Notice: Subject to any disclaimer, the term of this patent is extended or adjusted under 35 U.S.C. 154(b) by 217 days.

(21) Appl. No.: 12/501,579

(22) Filed: Jul. 13, 2009

Related U.S. Application Data

(60) Provisional application No. 61/134,821, filed on Jul. 14, 2008.

(51) Int. Cl.
*G08B 1/00* (2006.01)
*G08B 25/00* (2006.01)

(52) U.S. Cl. ..... 340/309.7; 340/309.16; 368/109; 368/244

(58) Field of Classification Search ..... 340/309.7, 340/691.1, 691.6, 692, 4.3, 6.1, 309.16, 309.8, 340/309.9; 15/105, 167.1; 368/10, 107, 368/12, 109, 244, 262
See application file for complete search history.

(56) References Cited

U.S. PATENT DOCUMENTS

| | | | | |
|---|---|---|---|---|
| 1,923,978 | A | | 4/1930 | Hill |
| 1,973,390 | A | | 9/1934 | Plants |
| 3,542,519 | A | | 11/1970 | Montalto et al. |
| 3,783,364 | A | | 1/1974 | Gallanis et al. |
| 3,803,579 | A | | 4/1974 | Compton |
| 4,361,408 | A | | 11/1982 | Wirtschafter |
| 4,367,955 | A | | 1/1983 | Ballew |
| 4,382,688 | A | | 5/1983 | Machamer |
| 4,836,415 | A | | 6/1989 | Grussmark |
| 4,866,807 | A | | 9/1989 | Kreit et al. |
| 4,991,755 | A | | 2/1991 | Grusmark |
| 5,184,959 | A | * | 2/1993 | Oryhon et al. ..... 434/263 |
| 5,228,595 | A | | 7/1993 | Booker |
| 5,259,086 | A | | 11/1993 | Fong |
| 5,339,479 | A | | 8/1994 | Lyman |
| 5,438,726 | A | * | 8/1995 | Leite ..... 15/105 |
| 5,570,325 | A | | 10/1996 | Arpadi |
| 5,572,762 | A | | 11/1996 | Scheiner |
| 5,629,527 | A | * | 5/1997 | Levitt et al. ..... 250/455.11 |
| 5,673,451 | A | | 10/1997 | Moore et al. |
| 5,704,087 | A | | 1/1998 | Strub |
| 5,771,925 | A | | 6/1998 | Lewandowski |
| 5,839,578 | A | | 11/1998 | Avery et al. |
| 5,864,288 | A | | 1/1999 | Hogan |
| 5,894,453 | A | | 4/1999 | Pond |
| 5,944,531 | A | | 8/1999 | Foley et al. |
| 6,029,304 | A | | 2/2000 | Hulke et al. |
| 6,074,076 | A | | 6/2000 | Parrish-Bhagwat |
| 6,106,294 | A | | 8/2000 | Daniel |
| 6,154,912 | A | | 12/2000 | Li |
| 6,199,239 | B1 | * | 3/2001 | Dickerson ..... 15/105 |
| 6,345,015 | B1 | | 2/2002 | Coulson |
| 6,536,068 | B1 | | 3/2003 | Yang et al. |
| 6,954,961 | B2 | | 10/2005 | Ferber et al. |
| 7,233,228 | B2 | | 6/2007 | Lintell |
| 7,682,153 | B2 | * | 3/2010 | Hilfinger et al. ..... 433/216 |
| 7,976,388 | B2 | * | 7/2011 | Park et al. ..... 463/37 |

* cited by examiner

*Primary Examiner* — Toan N Pham
(74) *Attorney, Agent, or Firm* — Patent Law Offices of Rick Martin, P.C.

(57) ABSTRACT

A toothbrush alarm consists of an alarm box located in the bedroom. It has an alarm such as a noisemaker, radio, light and/or voice chip saying "please brush your teeth." In intermittent periods it is controlled ON and OFF by a battery powered alarm clock circuit built into a toothbrush. A wireless transmitter in the toothbrush sends the ON or OFF command to the alarm box.

The alarm box will repeatedly remind the child to brush their teeth until it is turned off from the toothbrush. Thus, a child sets his alarm time on his toothbrush in the bathroom and leaves the toothbrush there. At wakeup time (or brushing time) the child must go to the bathroom, pick up the toothbrush, turn off the alarm, and (hopefully) brush his/her teeth.

7 Claims, 3 Drawing Sheets

CHILDREN'S TOOTHBRUSH REMINDER SET

CROSS REFERENCE APPLICATIONS

This application is a non-provisional application claiming the benefits of provisional application No. 61/134,821 filed Jul. 14, 2008.

FIELD OF INVENTION

The present invention relates to encouraging a child to brush his/her teeth by means of setting off an alarm in the bedroom. The only way to turn off the alarm is to walk to the bathroom, pick up the toothbrush and push OFF button on the toothbrush.

BACKGROUND OF THE INVENTION

The closest known art is U.S. Pat. No. 5,184,959 (1993) to Oryhon et al. The air circuitry of this patent is incorporated herein by reference. An alarm clock serves as a stand for a toothbrush. When the alarm goes off the user must remove the toothbrush to turn off the alarm. Thus, the child is motivated to brush his/her teeth because he/she is awake and holding a toothbrush.

The problem with this invention is that the child could still be in bed and merely set the toothbrush back into the stand.

What is needed is a system to make the child walk to the bathroom and hold the toothbrush while in the bathroom, thus increasing the likelihood the child will use the toothbrush.

The present invention meets that need by placing an alarm voice box in the bedroom. An electric toothbrush contains the clock and alarm circuitry and a transmitter to turn the alarm voice box ON or OFF. The toothbrush is left in the bathroom. Thus, when the alarm voice box sounds, the child must travel to the bathroom, pick up the toothbrush and shut off the alarm. With the child standing at the sink holding a toothbrush, the chances increase he/she will actually brush their teeth.

SUMMARY OF THE INVENTION

An aspect of the present invention is to provide a two piece toothbrush alarm clock, wherein the alarm box is located at bedside, and the clock/alarm set circuitry is mounted inside the toothbrush which is kept by the bathroom sink.

The purpose of the Children's Toothbrush Reminder Set is to remind children to brush their teeth. It includes a toothbrush and a voice box, which together will remind children to brush their teeth.

The toothbrush has an alarm and LCD screen, it also may have a small speaker with lights encompassed around the handle of the brush. The toothbrush's alarm can be set for a specific time to remind children to brush their teeth. The voice box is only controlled by the toothbrush and can only be turned off or deactivated by the toothbrush.

The voice box is placed in the bedroom. The voice box's alarm is controlled by the toothbrush's alarm circuitry. It will alarm for whatever time the toothbrush alarms, although it does not have a visible clock. This control will occur from the wireless internal circuitry, such as a Bluetooth device/signal or infrared signal. When the voice box alarms, the lights on the voice box will blink repeatedly and the voice box repeats the task, "Please brush your teeth". The voice box, which will typically be located in the bedroom, will continue to do this until the child goes into the bathroom (where the toothbrush is typically located), picks up the toothbrush and pushes the deactivation button located on the toothbrush.

The usefulness is that it saves parents the hassle of repeatedly telling their children to brush their teeth, i.e. such as in the mornings when everyone's busy preparing for work and/or school. The child will have the reminder from the voice box that they can not turn off until they pick up the toothbrush.

The toothbrush is water resistant. It is approximately 7½ inches long, with approximately 1-1½ inches circumference handle which narrows to the top of the toothbrush. The brush head may be interchangeable. The handle of the toothbrush has a LCD screen approximately ¾ inches in length and is approximately ¼ inches from the base. Right below (or above) the LCD screen are 3 buttons; one sets the alarm; one deactivates the voice box and the toothbrush alarm; and the third button sets the time (in hours and minutes). Above the LCD screen may be a small speaker which emits the alarm sound, this is a typical alarm sound. Around the handle of the toothbrush (on one side or both sides) are lights which will blink repeatedly until the alarm is canceled. The lights will vary in color, are very small and embedded in the handle (to avoid hazard if toothbrush is broken). The bottom side of the toothbrush's base is the battery compartment.

The voice box transmitter is approximately a 5 by 5 box made of a durable plastic material. The color of the set will vary. Located inside the voice box transmitter (which is sealed) are the internal parts of the speaker and the voice transmitter parts, as well as the device to send signal from the toothbrush to the voice box. The front side of the voice box has a speaker with colorful lights encompassed around it. There is an optional volume button located below the speaker. There are optional speakers on each side which are smaller than the main speaker in the front. The battery compartment is located on the bottom of the voice box, or it could be A/C powered. The toothbrush may rest in a battery charger stand.

Other aspects of this invention will appear from the following description and appended claims, reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
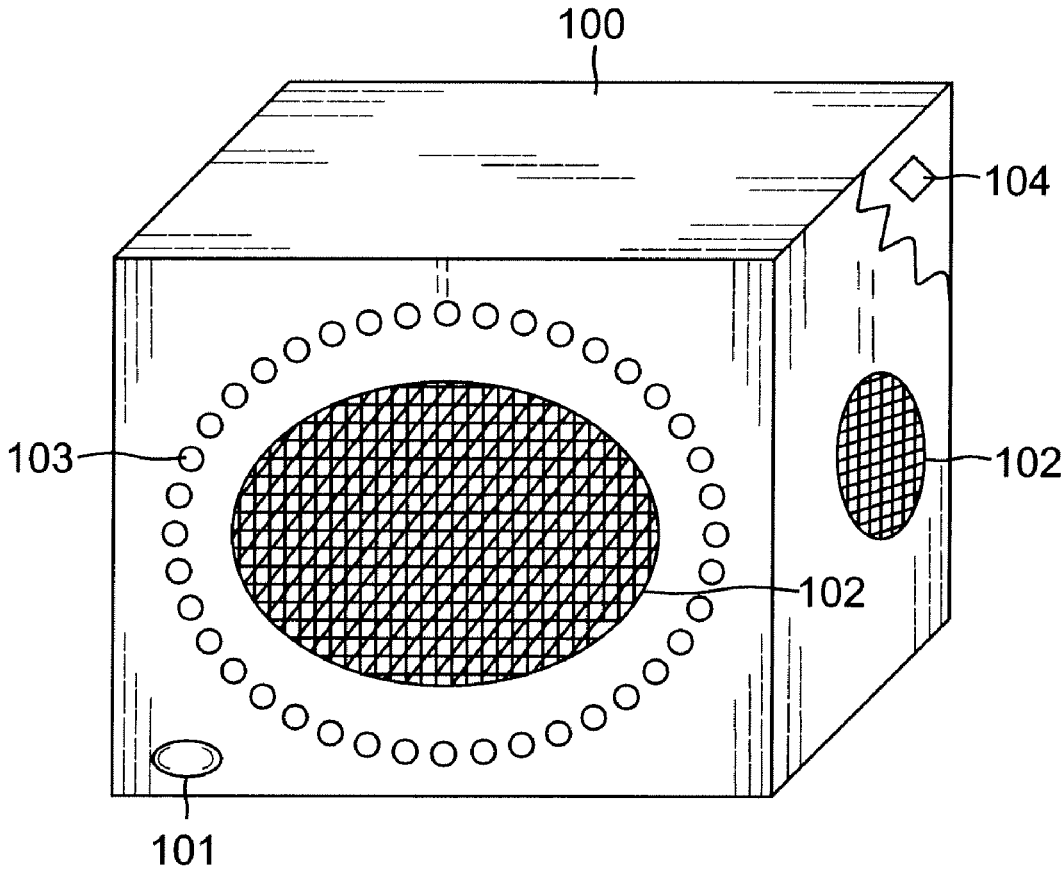
FIG. 1 is a front perspective view of the two piece preferred embodiment.
Figure 2:
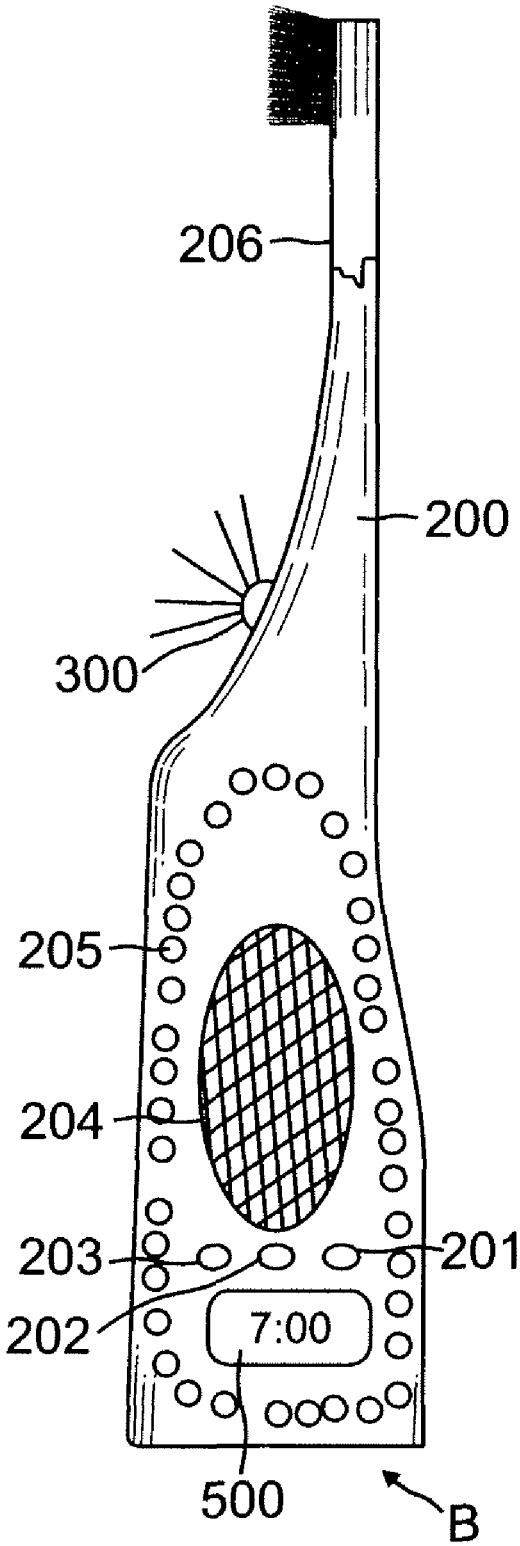
FIG. 2 is a front elevation view of the toothbrush.
Figure 3:
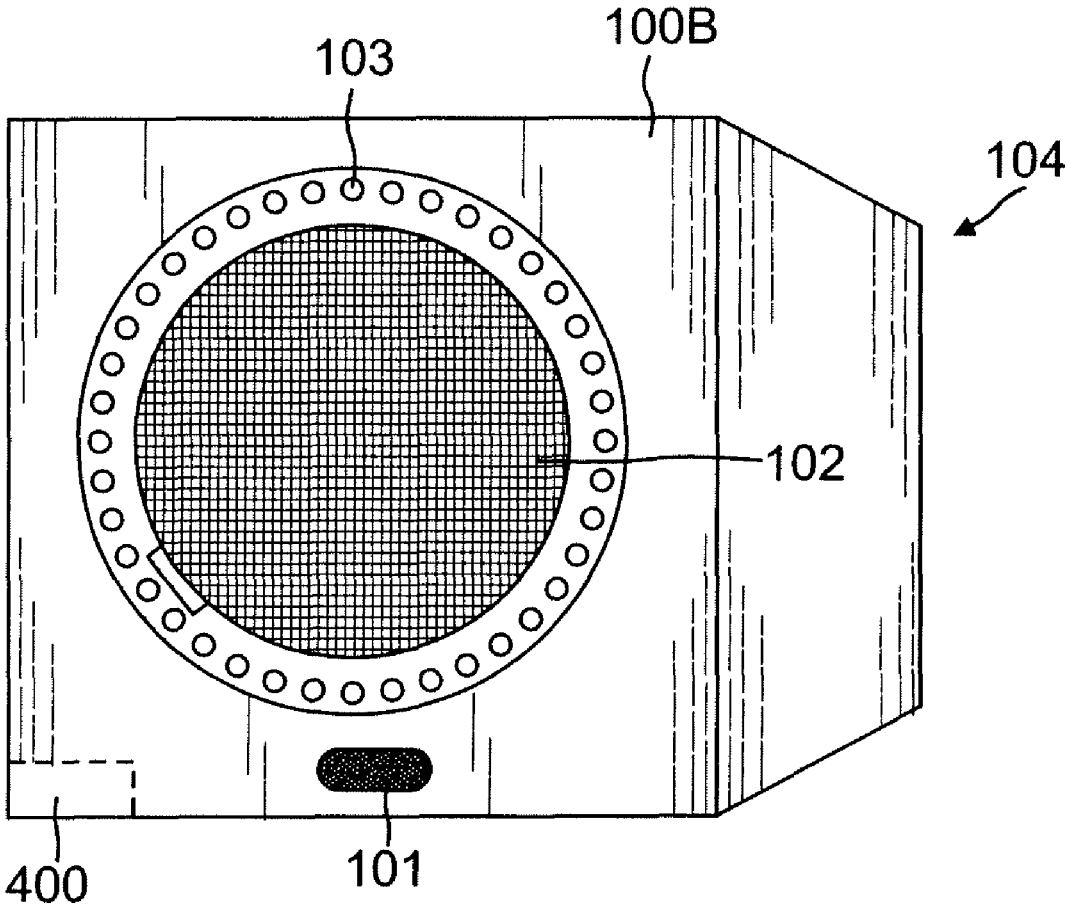
FIG. 3 is a front perspective view of the battery powered alarm voice box.

The alarm box 100 or 100B, FIG. 3 may be A/C or battery powered. FIG. 3 alarm box 100B has a battery compartment 400. It has no controls except an optional volume control 101. An alarm speaker(s) 102 is necessary. Flashing alarm lights 103 are optional. A wireless ON/OFF receiver 104 with control circuitry to drive the alarm speaker 102 is necessary. An optional alarm circuit may provide a voice alarm such as "Please brush your teeth," repeated until an alarm shut off signal is received which would be sent by the alarm clock toothbrush 200.

The alarm clock toothbrush 200 must have a battery powered circuit, alarm circuit and wireless transmitter 300 to control the alarm box 100. Control functions include a time set button 201, an alarm set button 202, and an alarm OFF button 203. Clearly equivalent designs could incorporate a single button, multi-push circuit to run these functions. Optionally the toothbrush 200 may have its own alarm speaker 204 and/or alarm lights 205, optional changeable brush heads 206 may be included.

A power source such as battery B or a battery charger to a battery (not shown) runs the toothbrush circuitry.

In operation the alarm box 100 is placed in the bedroom. Normally the power is continuous to always be on alert to receive an ON or OFF signal from the wireless transmitter 300.

The toothbrush alarm clock 200 is battery powered with a display 500. It is placed in the bathroom. The time is set with button 201. The alarm time is set with button 202 all in a known manner. When the alarm is triggered, the wireless transmitter 300 sends the ON signal to the alarm box 100.

The only way to turn the alarm box off is to push the OFF button 203 on the toothbrush.

Although the present invention has been described with reference to preferred embodiments, numerous modifications and variations can be made and still the result will come within the scope of the invention. No limitation with respect to the specific embodiments disclosed herein is intended or should be inferred. Each apparatus embodiment described herein has numerous equivalents.

I claim:

1. A method to encourage a child to brush his teeth, the method comprising the steps of:

manufacturing an alarm box with an alarm and a wireless control signal receiver;

placing the alarm box at a user's bedside and supplying power thereto;

manufacturing an alarm clock toothbrush having a battery, an alarm clock, and a wireless ON/OFF control signal transmitter;

placing the alarm clock toothbrush in a bathroom;

setting an alarm time and actual time on the alarm clock toothbrush;

reaching the alarm time and sending an ON control signal from the alarm clock toothbrush to the alarm box, setting off the alarm;

traveling from the bedroom to the bathroom;

picking up the alarm clock toothbrush and activating an OFF switch; and transmitting an OFF control signal from the alarm clock toothbrush to the alarm box, thereby turning the alarm off.

2. The method of claim 1, further comprising the step of adding an alarm to the alarm clock toothbrush.

3. The method of claim 1, further comprising the step of including a voice chip in the alarm box.

4. An alarm system comprising:

an alarm box having a wireless receiver to receive an ON control signal and an OFF control signal, and no further means to turn an alarm circuit OFF;

said alarm circuit having an alarm means functioning to wake up a user;

an alarm clock toothbrush having an alarm clock with a clock and an alarm set means;

said alarm clock having a wireless control signal transmitter and an alarm OFF switch; and wherein upon reaching the alarm set time the transmitter sends an alarm ON control signal to the alarm box; and wherein the user can only turn the alarm box off by activating the alarm OFF switch on the alarm clock toothbrush.

5. The system of claim 4, wherein the alarm clock toothbrush is battery powered.

6. The system of claim 4, wherein the alarm clock toothbrush has an alarm means of its own which functions in parallel with the alarm box.

7. The system of claim 4, wherein the alarm box further comprises a voice chip as part of the alarm means.

* * * * *